United States Patent [19]

Barman et al.

[11] 4,245,315

[45] Jan. 13, 1981

[54] IGNITION LIMP HOME CIRCUIT FOR ELECTRONIC ENGINE CONTROL SYSTEMS

[75] Inventors: Alan W. Barman, Oak Park; Thomas W. Hartford, Livonia; Robert S. Henrich, Farmington Hills, all of Mich.

[73] Assignee: The Bendix Corporation, Southfield, Mich.

[21] Appl. No.: 881,984

[22] Filed: Feb. 27, 1978

[51] Int. Cl.[3] ..... F02P 5/08; F02P 11/06

[52] U.S. Cl. ..... 364/431; 123/486; 371/11

[58] Field of Search ..... 364/424, 431, 422; 123/32 EA, 32 EB, 32 EL, 32 EK, 117 R, 117 D

[56] References Cited

U.S. PATENT DOCUMENTS

| | | | |
|---|---|---|---|
| 4,094,274 | 6/1978 | Harada et al. | 123/32 EL |
| 4,099,495 | 7/1978 | Kiencke et al. | 123/32 EB |
| 4,127,092 | 11/1978 | Fresow et al. | 123/117 D |
| 4,128,082 | 12/1978 | Aoki | 123/32 EA |

*Primary Examiner*—Felix D. Gruber

*Attorney, Agent, or Firm*—Gaylord P. Haas, Jr.; Russel C. Wells

[57] ABSTRACT

A method and apparatus for controlling the various functions of an internal combustion engine using a program controlled microprocessor having a memory preprogrammed with various control laws and associated control schedules receives information concerning one or more engine-operating parameters such as manifold absolute pressure, throttle position, engine coolant temperature, air temperature, engine speed or period and the like. These parameters are measured and their value or status is supplied to input circuits for signal conditioning and conversion into digital words usable by the microprocessor. The microprocessor system computes a digital word indicative of a particular computer-commanded engine control operation and output circuitry responds to predetermined computer-generated commands and to the computed digital words for converting it into a corresponding pulse-width control signal for controlling such engine operations as fuel-injection, ignition timing, proportional and/or on-off EGR control, and the like. The engine control system further includes "limp home" circuitry for enabling the engine to function for a predetermined time even after the microprocessor fails to enable the vehicle to get to a place of repair or the like.

4 Claims, 10 Drawing Figures

Microprocessor-Based Electronic Engine Control System

Reset Control System

IGNITION LIMP HOME CIRCUIT FOR ELECTRONIC ENGINE CONTROL SYSTEMS

BACKGROUND OF THE INVENTION

1. Field of the Invention

Figure 2:
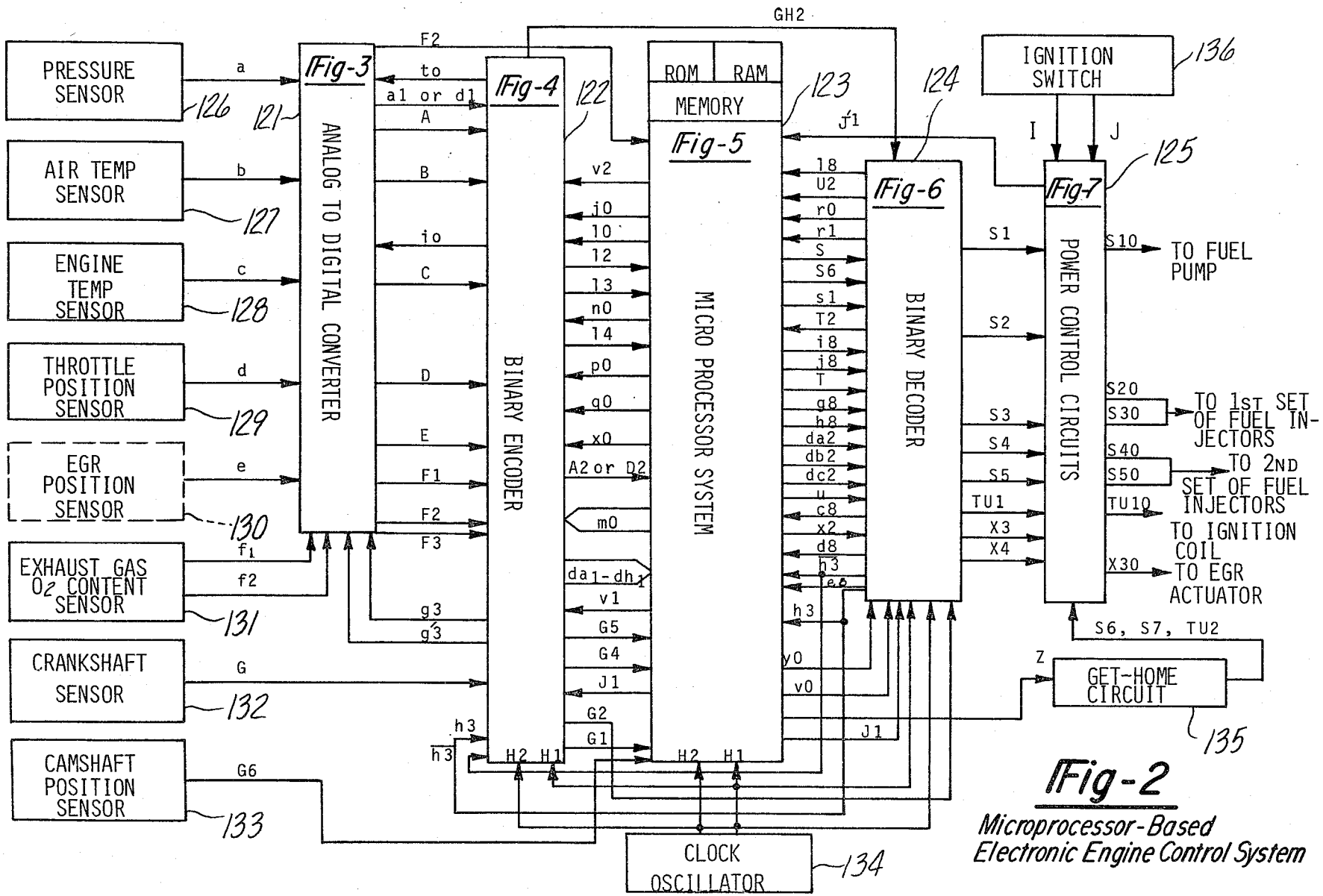
Figure 5A:
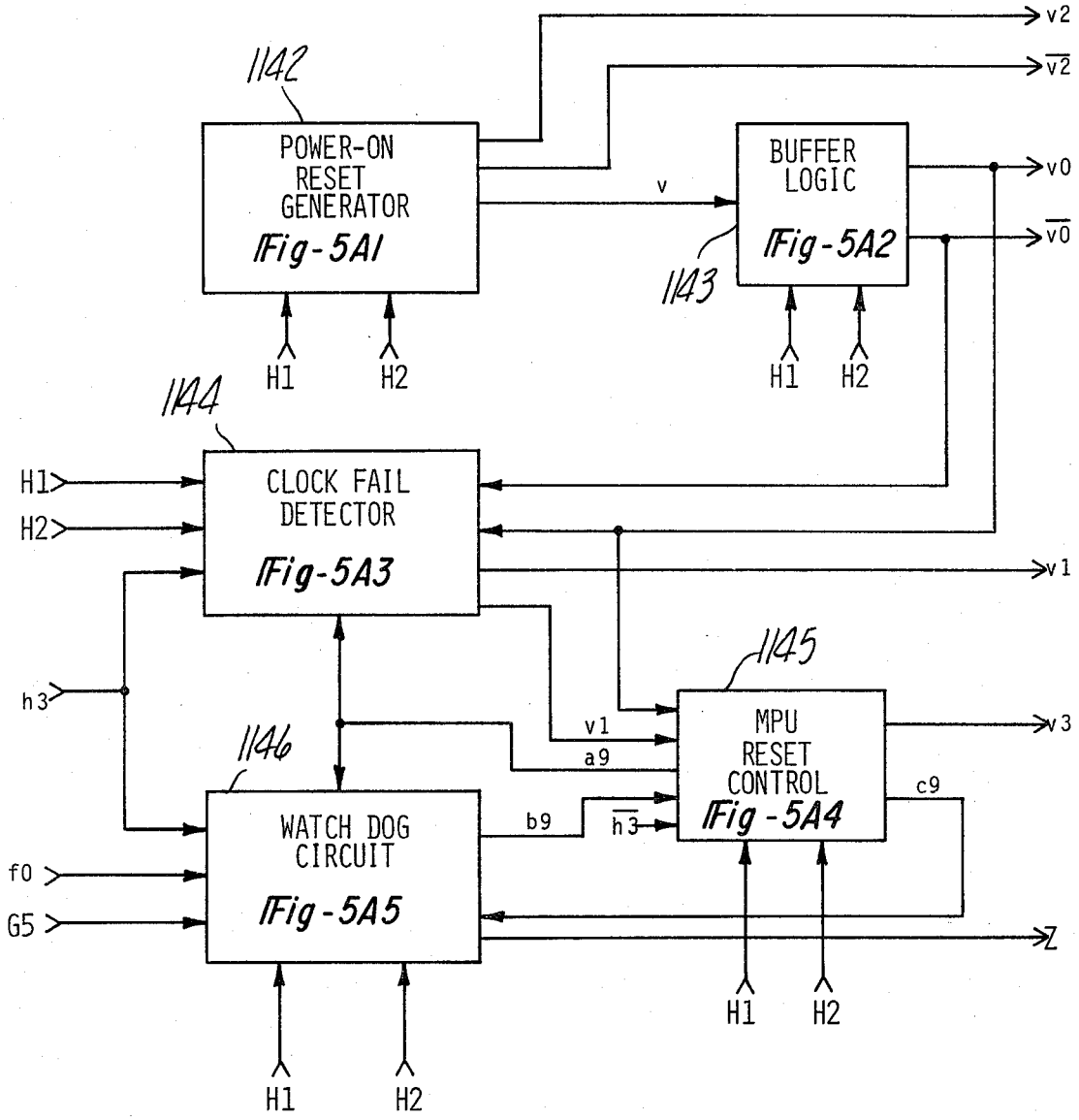

This invention relates generally to a method and apparatus for controlling an internal combustion engine, and more particulary to a microprocessor-based electronic engine control system having a memory preprogrammed with various control laws and control schedules responsive to one or more sensed engine-operating parameters for generating signals for controlling fuel injection, ignition timing, EGR control, or the like.

2. Statement of the Prior Art

Many of the patents of the prior art recognize the need for employing the enhanced accuracy of digital control systems for more accurately controlling one or more functions of an internal combustion engine.

U.S. Pat. No. 3,969,614 which issued to David F. Moyer, et al on July 13, 1976 is typical of such systems as are U.S. Pat. No. 3,835,819 which issued to Robert L. Anderson, Jr. on Sept. 17, 1974; U.S. Pat. No. 3,904,856 which issued to Louis Monptit on Sept. 9, 1975; and U.S. Pat. No. 3,906,207 which issued to Jean-Pierre Rivere, et al on Sept. 16, 1975. All of these patents represent a break-away from the purely analog control system of the past, but neither the accuracy, reliability, or number of functions controlled is sufficient to meet present day requirements.

Many of the modern electronic engine control systems simply stop operating in the event of a system failure particularly where the electronic operation thereof is dependant upon a digital clock or the like and the clock fails. No provisions are made for enabling the vehicle to travel at least a short distance for the purpose of repairs or the like.

SUMMARY OF THE INVENTION

The present invention provides means to producing an engine position pulse for a predetermined position for every cylinder. This engine position pulse is timed, in the preferred embodiment of the present invention, so that it occurs at approximately the top-dead-center position of each cylinder. Means are provided for detecting when the engine control system has failed by watching for program-generated pulses produced during normal operation of the microprocesser. A failure indication causes the normal ignition signal to be disconnected from the system and the "limp home" ignition signal of the present invention to be connected. The connections means employ transmission gates for connecting one or the other of the ignition control signals to circuit means driving a primary of the ignition coil. Means responsive to said engine position pulses may be used to fire a spark plug at its top-dead-center position so as to allow the vehicle to operate sufficiently to get to a repair center but badly enough so that the driver will know that something is wrong and the repairs are in order.

This application is one of fourteen applications filed on Feb. 27, 1978, all commonly assigned and having substantially the same specification and drawings, the fourteen applications being identified below:

| Ser. No. | Title |
|---|---|
| 881,321 | Microprocessor-Based Electronic Engine Control System |
| 881,322 | Feedback-Compensated Ramp-Type Analog to Digital Converter |
| 881,323 | Input/Output Electronic For Microprocessor-Based Engine Control System |
| 881,324 | Switching Control of Solenoid Current in Fuel Injection Systems |
| 881,921 | Dual Voltage Regulator With Low Voltage Shutdown |
| 881,922 | Oxygen Sensor Qualifier |
| 881,923 | Ratiometric Self-Correcting Single Ramp Analog To Pulse Width Modulator |
| 881,924 | Microprocessor-Based Engine Control System Acceleration Enrichment Control |
| 881,925 | Improvements in Microprocessor-Based Engine Control Systems |
| 881,981 | Oxygen Sensor Feedback Loop Digital Electronic Signal Integrator for Internal Combustion Engine Control |
| 881,982 | Improvements in Electronic Engine Controls System |
| 881,983 | Electronic Fuel Injection Compensation |
| 881,984 | Ignition Limp Home Circuit For Electronic Engine Control Systems |
| 881,985 | Oxygen Sensor Signal Conditioner |

Application Ser. No. 881,321, has been printed in its entirety and the specification of that application is specifically incorporated herein by reference.

We claim:

1. In an internal combustion engine system having an intake system, an exhaust system, an engine block, a plurality of engine cylinders disposed in said engine block, a piston operatively disposed for reciprocal movement within each of said plurality of cylinders, means for controllably supplying fuel to a selected one or more of said plurality of cylinders, means responsive to ignition control pulses for controlling the ignition of said fuel supplied to said selected one or more of said plurality of cylinders, sensor means for detecting when each of said pistons has attained a predetermined reference position within its corresponding cylinder and for generating an engine position pulse indicative thereof, said engine position pulses being representative of engine speed or period, a computerbased engine control system including computer means, memory means operatively associated with said computer means, program means stored within said memory means for implementing at least one control law, additional sensor means associated with said engine for measuring a plurality of engine-operating parameters and generating digital words indicative of said measured values and usable by said computer means, at least one multi-dimensional control surface to compute a modifier value functionally related to the actual measured value of said engine-operating parameter represented by said digital word and for implementing said at least one control law utilizing said computed modifier value for generating ignition control commands, means responsive to said ignition control commands for normally generating computer-calculated ignition control pulses, said means for controlling the ignition of said fuel supplied to a selected one or more of said plurality of cylinders being normally responsive to said computer-calculated ignition control pulses for controlling the time and duration of ignition in said selected one or more of said plurality of cylinders, the improvement comprising means for monitoring the normal operation of said computer means and said program means for detecting a malfunction in the operation thereof and generating a "fail" signal whenever the reliability of one or more of said computer-generated ignition control commands could be unreliable, means responsive to said engine position pulses for generating secondary ignition control pulses, and gating means responsive to the generation of said "fail" signal for terminating the supply of said normally-generated computer-calculated ignition control pulses to said ignition control means and supplying instead said secondary fuel control pulses to said ignition control means for controllably operating same so that the operation of said internal combustion engine, while degraded, is not terminated or controlled by unreliable or unsafe system commands, said computer means being responsive to the normal execution of said program means for generating a predetermined sequence of programmably spaced "operation OK" signals indicating that the operation of said computer means and said program means is normal and wherein said means for monitoring the normal operation, detecting a malfunction and generating said "fail" signal includes first counter means for counting engine position pulses, said first counter means being reset by the arrival of each subsequent "operation OK" signal for clearing and resetting said first counter means but being responsive to the attainment of a predetermined failure-indicating count representative of a failure of said first counter means to receive one of said resetting "operation OK" signals during the counting of a predetermined number of said engine position pulses for generating a "fail once" signal, means responsive to said "fail once" signal for generating a "master reset" signal for resetting said computer means, second counter means responsive to said "master reset" signal for initiating a second count, said second counter means counting out a predetermined test interval, said second counter means being responsive to the resumption of normal system operating as indicated by the resumption of the generation of said "operation OK" signals resetting said first counter means and preventing said predetermined failure-indicating count from being attained during the duration of said test interval, and means responsive to said second counter means completing said test count interval without said first counter means again attaining said predetermined failure-indicating count indicating that said "master reset" operation was successful and for erasing all memory of the first failure but responsive to a second attainment of said predetermined failure-indicating count in said first counter means during said test interval of said second counter means for indicating the occurrence of two successive failures and generating said "fail" signal to indicate the unreliability of said computer-calculated ignition control pulses.

2. An ignition limp home circuit for use in an electrically controlled internal combustion engine system wherein the ignition is normally controlled by an ignition control signal generated by the electrical control means of said internal combustion engine system, means for monitoring the normal operation and generation of said ignition control signals and generating a GO signal if normal operation is detected, means for monitoring a predetermined reference position in each of said plurality of cylinders and generating a sequence of periodic engine position pulses in response thereto, first counter means for counting said engine position pulses and generating a "first fail" signal whenever a predetermined maximum number of said engine position pulses are counted, means responsive to said GO signal for resetting said first counter means so that said "first fail" signal is never generated since said maximum number of engine position pulses are never counted unless normal system operation is disrupted to prevent the normal generation of said GO signals, means responsive to said "first fail" signal for generating a master reset signal for reinitializing the operation of said electrical control means in an attempt to restore the normal operation of said system, second counter means for counting out a predetermined test time interval means responsive to the generation of said master reset signal indicating the detection of a first failure for enabling said second counter means to begin counting said test time interval such that if said master reset signal was effective for storing normal system operation such tha said first counter means will be continually reset before it can count said predetermined number of engine position pulses to prevent the generation of a second failure signal during said test time interval thereby enabling said second counter means to erase all memory of said first failure, but if said master reset signal fails to restore normal operation and said first counter means counts said predetermined number of engine position pulses without being reset by one of said GO signals, indicating that a second subsequent failure has occurred, means responsive to the detection of two successive failures in spite of said electronic control means being re-initialized by said master reset signal for generating a FAIL signal, means responsive to said FAIL signal for converting said engine position pulses into a sequence of periodic "limp home" ignition control pulses, gating means normally responsive to the absence of said FAIL signal for transmitting said normally-generated ignition control pulses to said ignition control means for operating same and responsive to the presence of said FAIL signal for blocking the transmission of said normally-generated ignition control pulses and transmitting said "limp home" ignition control pulses to said ignition control means instead to enable said ignition control means to operate sufficiently to get the vehicle to a repair center but poorly enough so that the driver of said vehicle knows that repairs are in order.

3. The ignition limp home circuit of claim 2 wherein said means for generating said "limp home" ignition control pulses includes a monostable multivibrator and RC circuit means operatively coupled to said monostable multivibrator for setting the delay great enough to allow sufficient time for the ignition coil to discharge its stored energy to the spark plug being fired and still leave enough time to charge back up to a sufficient level for triggering the ignition in the next successive spark plug.

4. The ignition limp home circuit of claim 2 wherein said electronic control means includes computer means, memory means operatively associated with said computer means, program means stored within said memory means for execution by said computer means, the normal operation of said computer means and said program means resulting in the generation of said GO signals indicative of normal systems operation, and wherein said means for generating said "limp home" ignition control pulses includes multivibrator means responsive to said engine position pulses for generating a timed sequence of said "limp home" ignition control pulses and RC circuit means operatively coupled to said multivibrator means for controlling the pulse-width and duty cycle of said "limp home" ignition control pulses so as to provide a delay great enough to allow sufficient time for the ignition coil to discharge its stored energy into the spark plug being fired and still leave enough time to recharge said ignition coil back up to a sufficient level for causing ignition upon the firing of the next successive spark plug.

* * * * *